US006121210A

United States Patent [19]

Taylor

[11] Patent Number: 6,121,210

[45] Date of Patent: Sep. 19, 2000

[54] FOAMABLE SILICONE OIL COMPOSITIONS AND METHODS OF USE THEREOF

[75] Inventor: Anthony J. Taylor, Medina, Ohio

[73] Assignee: DAP Products Inc., Baltimore, Md.

[21] Appl. No.: 09/260,301

[22] Filed: Mar. 2, 1999

Related U.S. Application Data

[60] Provisional application No. 60/077,673, Mar. 12, 1998.

[51] Int. Cl.[7] ..... C10M 169/04

[52] U.S. Cl. ..... 508/208; 508/209; 508/211; 508/214

[58] Field of Search ..... 508/208, 214, 508/211, 209

[56] References Cited

U.S. PATENT DOCUMENTS

| | | |
|---|---|---|
| 406,585 | 7/1889 | King . |
| 2,016,986 | 10/1935 | Case . |
| 2,979,416 | 4/1961 | Drexler . |
| 3,317,140 | 5/1967 | Smith . |
| 3,346,195 | 10/1967 | Groth . |

(List continued on next page.)

FOREIGN PATENT DOCUMENTS

| | | |
|---|---|---|
| 1528159 | 10/1978 | United Kingdom . |
| 1536312 | 12/1978 | United Kingdom . |
| 9812247 | 3/1998 | WIPO . |
| 9812248 | 3/1998 | WIPO . |

OTHER PUBLICATIONS

ICI Americas, Inc. MSDS, for BRIJ 52, Nov. 9, 1994.
Osi Specialties, Inc. MSDS for LE–458 HS Nov. 19, 1997.
WD–40 Aerosol, MSDS for WD–40 Company.
WD–40 Aerosol—Lubricating Oil, General, MSDS for WD–40 Company.
WD–40 Aerosol—Corrosion Preventive Compound, MSDS for WD–40 Company.
WD–40 Aerosol—Lubricating Oil, General Purpose, MSDS for WD–40 Company.
WD–40 Aerosol—Corrosion Preventive Compound—Lubricating Oil, General Purpose, MSDS for WD–40 Company.
DAPtex, Latex Foam Sealant, MSDS,.

*Primary Examiner*—Jacqueline V. Howard
*Attorney, Agent, or Firm*—Biebel & French

[57] ABSTRACT

Foamable, silicone oil compositions and methods of lubricating surfaces with such compositions. Compositions in accordance with the invention may be sprayed onto surfaces from aerosol canisters or other spray containers to form stable foams which do not run or drip, preferably for periods in excess of sixteen hours. A composition in accordance with the invention comprises an aqueous emulsion of a silicone oil. Oil-in-water emulsions of polysiloxanes, such as polydimethylsiloxane, having melting points no greater than about 32° F. (0° C.) are preferred. The composition further comprises a liquefiable gaseous propellant, preferably including a volatile liquid hydrocarbon or a mixture of volatile liquid hydrocarbons. The composition further comprises a solid, non-ionic lipophilic surfactant, preferably having an HLB value of about 3 to about 8, more preferably about 3.5 to about 6. Useful surfactants include fatty acid esters, fatty alcohol ethers and fatty acid amides. The high temperature stability of the composition may be improved by adding a high temperature foam stabilizer having a melting point greater than about 110° F. (43° C.). Preferred foam stabilizers include polar, linear saturated long chain fatty alcohols having twenty or more carbon atoms in the molecule.

53 Claims, 1 Drawing Sheet

U.S. PATENT DOCUMENTS 3,669,884 6/1972 Wright .
3,687,890 8/1972 Susuki et al. .
3,705,669 12/1972 Cox et al. .
3,843,586 10/1974 Wolf .
4,036,673 7/1977 Murphy et al. .
4,122,978 10/1978 Guimond et al. .
4,123,005 10/1978 Blunk .
4,248,724 2/1981 MacIntosh .
4,269,739 5/1981 Grejsner .
4,277,568 7/1981 Davison et al. .
4,328,319 5/1982 Osipow et al. .
4,350,774 9/1982 Scotti et al. .
4,363,737 12/1982 Rodriguez .
4,364,521 12/1982 Stankowitz .
4,381,066 4/1983 Page et al. .
4,384,661 5/1983 Page et al. .
4,422,877 12/1983 Spitzer et al. .
4,423,161 12/1983 Cobbs, Jr. et al. .
4,443,348 4/1984 Wright et al. .
4,463,039 7/1984 O'Connell et al. .
4,501,825 2/1985 Magyar et al. .
4,504,602 3/1985 O'Connell et al. .
4,559,369 12/1985 Bauman et al. .
4,584,324 4/1986 Bauman et al. .
4,692,473 9/1987 Wright et al. .
4,855,349 8/1989 Ingle .
4,863,518 9/1989 Blount .
4,880,557 11/1989 Ohara et al. .
4,931,479 6/1990 Morgan .
4,940,844 7/1990 Blunt .
4,960,802 10/1990 DiStefano .
4,996,240 2/1991 Osipow et al. .
4,999,383 3/1991 Blount .
5,037,011 8/1991 Woods .
5,055,511 10/1991 Ingle .
5,073,445 12/1991 Ingle .
5,084,503 1/1992 Iacoviello .
5,089,160 2/1992 Pallone et al. .
5,120,607 6/1992 Ingle .
5,135,813 8/1992 Ingle .
5,180,753 1/1993 Osipow et al. .
5,186,972 2/1993 Williams et al. .
5,188,263 2/1993 Woods .
5,219,609 6/1993 Owens .
5,236,606 8/1993 Rangel .
5,252,622 10/1993 DiStefano .
5,254,599 10/1993 Frank .
5,310,095 5/1994 Stern et al. .
5,331,016 7/1994 Frank et al. .
5,334,655 8/1994 Carlson et al. .
5,338,776 8/1994 Peelor et al. .
5,340,486 8/1994 Willoughby .
5,360,826 11/1994 Egolf et al. .
5,399,205 3/1995 Shinohara et al. .
5,409,148 4/1995 Stern et al. .
5,439,674 8/1995 Noda et al. .
5,450,983 9/1995 Stern et al. .
5,458,905 10/1995 Heagle .
5,476,879 12/1995 Woods et al. .
5,480,589 1/1996 Belser et al. .
5,489,048 2/1996 Stern et al. .
5,505,344 4/1996 Woods .
5,507,969 4/1996 Shinohara et al. .
5,524,798 6/1996 Stern et al. .
5,534,173 7/1996 Faber et al. .
5,549,836 8/1996 Moses .
5,583,095 12/1996 Kobayashi et al. .
5,721,199 2/1998 Moses ..... 508/208

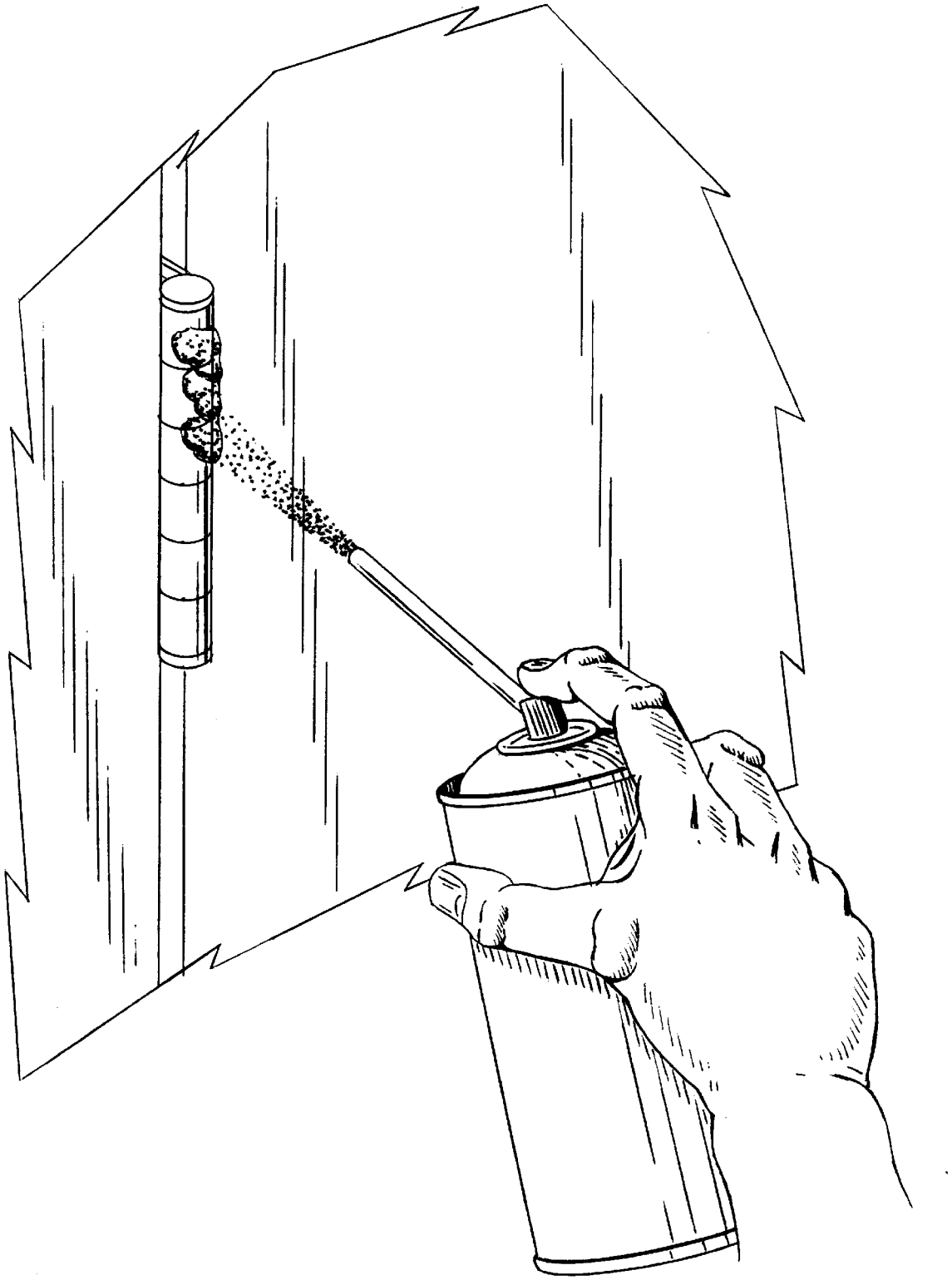

FOAMABLE SILICONE OIL COMPOSITIONS AND METHODS OF USE THEREOF

CROSS-REFERENCE TO RELATED APPLICATIONS

This application claims the benefit of U.S. Provisional patent application Ser. No. 60/077,673, filed Mar. 12, 1998.

FIELD OF THE INVENTION

The present invention pertains to foamable silicone oil compositions and methods of use thereof. The compositions, on foamed release thereof from aerosol canisters or the like, present stable foamed products capable of use as lubricants.

BACKGROUND OF THE INVENTION

It is known to use silicone oils as penetrating lubricants and moisture repellants for metal and plastic surfaces. For example, silicone oil-based aerosol spray products have been used for lubricating bearings and hinges to which liquid oils or greases cannot be easily applied. Petroleum-based oils, such as those available from the WD-40 Company of San Diego, Calif., have a number of disadvantages when compared to silicone-based lubricants, including disagreeable odors which can limit the indoor use of petroleum-based oils.

One drawback to the use of silicone oils is that such oils tend to run or drip when applied to surfaces, possibly contaminating neighboring surfaces. For example, silicone oil sprayed onto the brake calipers of a motor vehicle has been known to drip onto the rotors or pads, thereby reducing the friction of the brake.

Therefore, it is one object of the invention to provide a silicone oil-based foamable lubricant capable of forming a stable foam when extruded through the valve of an aerosol canister or other spray container.

SUMMARY OF THE INVENTION

These and other objects are met by the silicone oil-based foamable compositions and methods of use of the instant invention. Compositions in accordance with the invention may be sprayed onto surfaces to form stable foams which do not run or drip, preferably for periods in excess of sixteen hours. These foams, having viscosities preferably no greater than about $10^4$ centipoise (cP), retain the lubricity characteristics of silicone oils to provide lubricants capable of precise localized application.

A composition in accordance with the invention comprises an aqueous emulsion of a silicone oil. Oil-in-water emulsions of polysiloxanes, such as polydimethylsiloxane, having melting points no greater than about 32° F. (0° C.) are preferred.

The composition further comprises a liquefiable gaseous propellant, preferably including a volatile liquid hydrocarbon or a mixture of volatile liquid hydrocarbons.

The composition further comprises a solid, non-ionic lipophilic surfactant, preferably having an HLB value of about 3 to about 8, more preferably about 3.5 to about 6. These surfactants are water insoluble. Useful surfactants include fatty acid (i.e., $C_{12}$ and greater) esters fatty alcohol ethers and fatty acid amides. At present, the most preferred surfactants comprise one or more ethoxylated fatty alcohols.

The high temperature stability of the composition may be improved by adding a high temperature foam stabilizer having a melting point greater than about 110° F. (43° C.).

Preferred foam stabilizers include polar, linear saturated long chain fatty alcohols having twenty or more carbon atoms in the molecule. At present, behenyl alcohol is most preferred.

In addition to the above components, the foamable compositions may also comprise a dispersant/solvent such as isopropanol (IPA) to aid in dispersing or dissolving the surfactant and the high temperature foam stabilizer. IPA also aids in foam drying and acts as a heat sink when the solid surfactant is melted and mixed during preparation of the foamable compositions.

Typically, the surfactants and the high temperature foam stabilizer are melted and mixed with the dispersant/solvent. According to one form of the invention, a solid cationic water repellant is melted and mixed with the surfactants and the foam stabilizer. Then this mixture is combined with the silicone oil emulsion. Any desired additives, which may include, without limitation, rust inhibitors and anti-microbial agents, are blended into the combination. The resulting material is loaded into the desired container and charged with the propellant. The resulting composition is discharged under pressure through a valve of the container to form a lubricating foam.

Without wishing to be bound to any particular theory of operation it is thought that the surfactant coats the volatile liquid hydrocarbon propellant as the foamable composition is expelled from the pressurized container. The surfactant on foam dispensing, changes from the liquid phase into the solid phase where it is positioned along the water/organic interface. At that location, the surfactant functions as a foam builder, supporting the bubbles formed by the volatile hydrocarbon and the surrounding silicone oil. On evaporation of the propellant and water from the emulsion, the polymer bubbles are stabilized by the waxy surfactant and oil.

The present invention provides foamable lubricating compositions which do not run or drip when sprayed onto surfaces from aerosol containers. Such compositions may be applied to specific locations with minimal risk that the compositions will contaminate neighboring surfaces.

The invention will be further described in conjunction with the appended drawings and detailed description.

BRIEF DESCRIPTION OF THE DRAWINGS

The sole FIGURE is a schematic view showing use of the foamable compositions of the invention as a spray lubricant applied to a hinge.

DETAILED DESCRIPTION OF THE PREFERRED EMBODIMENT(S)

The compositions of the invention are contained, before foaming, in aerosol canisters or other spray containers that, after loading with the compositions, are pressurized to expel foamed beads or rope-like strands of material from the containers. Such containers are well known in the art and need not be explained herein. Suffice it here to state that such containers are operatively associated with sufficient valve means so as to selectively open the containers thereby allowing expulsion of the pressurized components housed therein and to close the containers after the desired foamed application. One aerosol container that may be adapted for use in providing a foamed lubricant product in accordance with the invention is shown in U.S. Pat. No. 3,705,669 (Cox).

The compositions of the invention comprise aqueous emulsions of silicone oil. Silicone oils are known to be water repellant but arc dispersable in water under certain conditions, such as in the presence of suitable emulsifiers. Preferred compositions comprise oil-in-water emulsions of polysiloxanes, such as polydimethylsiloxane, having melting points no greater than about 32° F. (0° C.). An especially preferred emulsion is available under the trademark LE-458 HS from OSi Specialties, Inc. of Greenwich, Conn.

In addition to the polydimethylsiloxane silicone oils, other silicone oils such as phenylmethyl silicone oil, amino-modified silicone oil, epoxy-modified silicone oil and fatty acid silicone oils can be mentioned.

The propellant constituents can be chosen from a wide variety of known propellants such as the $C_1$–$C_6$ alkanes and $C_1$–$C_6$ alkenes. In this regard, volatile liquid hydrocarbons such as propane, n-butane, isobutane, hexane, n-pentane, 2-methylbutane, 1-pentene, butene, 2-methyl-2-butene, cyclobutane. cyclopentane and cyclohexane can be employed. Less desirably, halogenated hydrocarbons such as vinyl chloride; methyl chloride; methyl bromide; dichlorodifluoromethane; 1,1,1,2-tetrafluoroethane; 1,1-difluoroethane; and the like may be employed although some of these are not favored due to environmental concerns. A detailed listing of liquid propellants may be seen in U.S. Pat. No. 4,381,066 (Page et al.), the disclosure of which is incorporated herein by reference.

The preferred surfactants include non-ionic solid, waxy lipophilic compounds having HLB values of about 3 to about 8, more preferably about 3.5 to about 6. These surfactants are water insoluble and are chosen from the group of fatty (i.e. $C_{12}$ or greater) acid esters, fatty alcohol ethers and fatty acid amides. As to the fatty alcohol ethers, these include alkoxylated (preferably Et—O—) fatty alcohols such as ethoxylated (2) cetyl alcohol, ethoxylated (2) stearyl alcohol and mixtures thereof. Especially preferred surfactants include those available under the trademarks Brij 52 and Brij 72 from ICI Americas Inc. of Wilmington, Del. and under the trademark Procol CA-2/SA-2 from Protameen Chemicals, Inc. of Totowa, N.J.

Preferably, a high temperature foam stabilizer having a melting point of about 110° F. (43° C.) or greater is added to improve the stability of the foam at temperatures above the melting points of the constituents of the surfactant. Most preferably, the foam stabilizer comprises a polar, linear saturated long chain fatty alcohol having more than about twenty carbon atoms in the molecule., such as behenyl alcohol. Behenyl alcohol, which has a melting point of 159.8° F. (71° C.). is available commercially from Protomeen Chemicals, Inc. of Totowa, N.J. and, in a less purified form, under the trademark 1822A from Henkel Corporation of Cincinnati, Ohio. Their commercially available products are mixtures of long chain fatty alcohols as described above wherein the majority of the molecules in the mixture have greater than twenty carbon atoms.

In addition to the above components, the foamable compositions may also comprise a dispersant/solvent such as isopropanol (IPA) to aid in dispersing the surfactant. IPA also aids in foam drying and acts as a heat sink when the solid surfactant is melted and mixed during preparation of the foamable compositions.

In addition, water repellant compounds can be included in the compositions as needed. In this regard, a host of such compounds are commercially available and may be used. At present, the cationic amines such as the quaternary ammonium salts are preferred. One such product is available under the trademark Mackernium SDC-85 from McIntyre Group Ltd., University Park, Ill. This product is a stearalkonium chloride available in flake form.

If ferrous metal containers are used to house the foamable compositions, it may be desirable to add minor amounts of rust inhibitor components to the composition. Rust inhibitors are available from many commercial suppliers. An exemplary rust inhibitor is available from Raybo Chemical Co. of Huntington, W. Va. under the trademark Raybo 60 No Rust.

Anti-microbial agents such as fungicides, algaecides, mildewicides and the like may also be added to the composition. One such fungicide is sold under the trademark Polyphase AF1 and is available from Troy Corporation of East Hanover, N.J.

| Exemplary compositions may include the following components: | | |
|---|---|---|
| a) silicone oil o/w emulsion | ≧85 | (wt % based on weight of foamable composition prior to charge of propellant) |
| b) surfactants | 1–10 | (wt % based on weight of foamable composition prior to charge of propellant) |
| c) high temperature foam stabilizer | 0.25–10 | (wt % based on weight of foamable composition prior to charge of propellant) |
| d) dispersant/solvent | 1–10 | (wt % based on weight of foamable composition prior to charge of propellant) |
| e) water repellant | 0–5 | (wt % based on weight of foamable composition prior to charge of propellant) |
| f) rust inhibitor | 0–5 | (wt % based on weight of foamable composition prior to charge of propellant) |
| g) anti-microbial agent | 0–5 | (wt % based on weight of foamable composition |
| a)–g) add up to 100 wt % | | prior to charge of propellant) |
| propellant | 2–10 | (wt % based on weight of the composition including propellant) |

Typically, the surfactants, the high temperature foam stabilizer and, if desired, the water repellant are melted and mixed with the dispersant/solvent. Then this mixture is combined with the silicone oil emulsion. Subsequently, the rust inhibitor, the anti-microbial agent or other additives are blended into the mixture. The resulting mixture is loaded into the desired container and charged with the propellant. Optimal pressure within the container is around 10 psig [370 $N/m^2$ (gauge)] at room temperature.

The following examples are illustrative only and it is not intended that the invention be restricted thereto.

EXAMPLE 1

A foamable composition was prepared having the following components:

| A foamable composition was prepared having the following components: | |
|---|---|
| silicone oil o/w emulsion | 85.75 wt % |
| ethoxylated (2) cetyl ether surfactant | 5.16 wt % |
| behenyl alcohol | 1.84 wt % |
| isopropanol (IPA) | 4. wt % |
| ethylene glycol | 2. wt % |
| rust inhibitor | 1.25 wt % |

The silicone oil o/w emulsion was available from OSi Specialties, Inc. of Greenwich. Conn. under the trademark LE-458 HS. The LE-458 HS emulsion consisted of less than 5 wt % proprietary additives including an ethoxylated aryl, less than 50 wt % water, and the remainder polydimethylsiloxane, the total being 100 wt %. The ethoxylated (2) cetyl ether surfactant was available under the trademark Brij 52 from ICI Americas Inc. of Wilmington, Del. The rust inhibitor was available under the trademark Raybo 60 No Rust from Raybo Chemical Co. of Huntington, W. Va.

The surfactant and the high temperature foam stabilizer were melted and mixed with the IPA. The mixture was combined with the silicone oil emulsion and the rust inhibitor was blended into the combination. A quantity of the resulting emulsion material was loaded into an aerosol container and charged with a hydrocarbon propellant in the ratio of approximately 2.93 wt % propellant to 97.07 wt % emulsion material.

The stability of foams produced from this composition was tested by extruding the composition through the valve of the container to form a bead of the material on a flat, impermeable surface. The bead did not substantially contract, even after eighteen hours. Despite this, it was not observed to run. The height of the bead was measured at periodic intervals, with the following results:

| TIME AFTER EXTRUSION | BEAD HEIGHT |
|---|---|
| 0 min. | 19 mm |
| 11 min. | 15 mm |
| 12 min. | 14 mm |
| 1 hr., 31 min. | 13 mm |
| 18 hr., 33 min. | 13 mm |

These results show that the exemplary composition produced a stable lubricant foam bead which retained over 68% of its original bead height even after eighteen hours.

EXAMPLE 2

A foamable composition was prepared having the following components:

| A foamable composition was prepared having the following components: | |
|---|---|
| silicone oil o/w emulsion | 85.75 wt % |
| ethoxylated (2) stearyl ether surfactant | 5.16 wt % |
| behenyl alcohol | 1.84 wt % |
| IPA | 4. wt % |
| ethylene glycol | 2. wt % |
| rust inhibitor | 1.25 wt % |

The silicone oil o/w emulsion was available from OSi Specialties, Inc. of Greenwich, Conn. under the trademark LE-458 HS. The ethoxylated (2) stearyl ether surfactant was available under the trademark Brij 72 from ICI Americas Inc. of Wilmington, Del. The rust inhibitor was available under the trademark Raybo 60 No Rust from Raybo Chemical Co. of Huntington. W. Va. The composition was prepared in accordance with the method used to prepare the composition of Example 1, except that the surfactant/high temperature foam stabilizer/silicone oil emulsion material was charged with hydrocarbon propellant in the aerosol container in the ratio of approximately 3.21 wt % propellant to 96.79 wt % emulsion material.

As was true of the composition of Example 1, a bead formed by extruding the composition of Example 2 through the aerosol valve did not substantially collapse, even after eighteen hours. Despite this, it was not observed to run. The height of the bead was measured at periodic intervals, with the following results:

| TIME AFTER EXTRUSION | BEAD HEIGHT |
|---|---|
| 0 min. | 23 mm |
| 11 min. | 20 mm |
| 13 min. | 20 mm |
| 16 min. | 20 mm |
| 18 min. | 20 mm |
| 16 hr., 28 min. | 20 mm |

These results show that the composition of Example 2 produced a stable lubricant foam bead which retained over 86% of its original bead height even after more than about sixteen hours.

EXAMPLE 3

A foamable composition was prepared having the following components:

| A foamable composition was prepared having the following components: | |
|---|---|
| silicone oil o/w emulsion | 89.2 wt % |
| ethoxylated fatty alcohol surfactant | 1.7 wt % |
| IPA | 4. wt % |
| synthetic fibers | 1. wt % |
| ethylene glycol | 2. wt % |
| water repellant | 0.7 wt % |
| rust inhibitor | 1.25 wt % |
| anti-microbial agent | 0.2 wt % |

The silicone oil o/w emulsion was available from OSi Specialties, Inc. of Greenwich, Conn. under the trademark LE-458 HS. The surfactant was a mixture of approximately 60 wt % ethoxylated (2) cetyl alcohol to approximately 40 wt % ethoxylated (2) stearyl alcohol available under the trademark Procol CA2/SA2 from Protameen Chemicals, Inc. of Totowa, N.J.

The synthetic fibers were available under the trademark Pulplus TA-12 and were added in an effort to increase the cohesion of the foam. It was observed that compositions having greater than about 1 wt % fibers tended to clog the valve of the aerosol container.

The water repellant was a flaked stearalkonium chloride cationic repellant available under the trademark Mackemium SDC-85 from McIntyre Group Ltd., University Park, Ill. The rust inhibitor was available under the trademark Raybo 60 No Rust from Raybo Chemical Co. of Huntington, W. Va. The anti-microbial agent was a fungicide available under the trademark Polyphase AF1 from Troy Corporation of East Hanover, N.J.

The surfactant, the high temperature foam stabilizer and the water repellant were melted and mixed with the isopropanol. The mixture was then combined with the silicone oil emulsion. The rust inhibitor and the anti-microbial agent were blended into the mixture. A quantity of the resulting mixture was loaded into an aerosol container and charged with a hydrocarbon propellant.

The composition of Example 3 had a measured dynamic viscosity of 4,567 cP, well below the maximum of $10^4$ cP.

The stability of foams produced from the composition of Example 3 was tested by extruding the composition through the valve of the container to form a bead of the material on a flat, impermeable surface. The foam did not dry even after eighteen hours. The bead, which had an initial height of 17 mm, maintained a height of 15 mm, that is, over 88% of its original height, after 18 to 24 hours.

The tendency of the foam to run was tested by extruding a 2 cm×10 cm bead of the material onto a rectangle of the same size drawn on a vertically suspended piece of paper. The "slump" of the bead was measured as the distance which the bead migrated under the force of gravity from the bottom perimeter of the rectangle after a dry time of 16 to 24 hours. The slump of foams produced by the composition of Example 3 was measured to be 49 mm. These results showed that the foams produced by the composition of Example 3 had a strong resistance to running.

The foamable compositions in accordance with the invention can be used as penetrating lubricants and water repellants for metal and plastic parts in the same manner as commercially-available silicone oil sprays. For example, in the FIGURE, the foamed composition 10 is applied to lubricate a hinge 12 by spraying or extruding the composition from an aerosol canister or spray can 14. The foamed composition 10 forms beads on the surface of the hinge 12 which resist running or dripping. A portion of the foamed composition 10 penetrates between hinge members 20, 22 to lubricate the interior of the hinge 12.

Accordingly, in its broadest contexts, the invention pertains to lubricating compositions comprising aqueous emulsions including silicone oil and solid, non-ionic lipophilic surfactants capable of forming stable foams when sprayed from aerosol canisters or other spray containers. Preferably, high temperature foam stabilizers having melting points greater than approximately 110° F. (43° C.) are included in the compositions to improve the stability of the foam at high temperatures. The foamed lubricants do not run or drip when applied to a specific locations on surfaces, thereby minimizing the risk of contaminating neighboring surfaces.

An effective amount of the foamable lubricating composition is applied, via foaming, onto the desired surface to provide lubrication thereto. In accordance with the invention, a stable foam is thereby supplied to the surface. The foam is a durable foam that will not substantially collapse and, as set forth above a foam bead or the like will retain at least about ⅔ of its applied height about 16 hours after application. Therefore, the foamed lubricant will stay in place for protracted periods and effectively provide lubricating action to the desired machine part etc.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A foamable composition adapted for storage in a spray container having a valve associated therewith for dispensing the contents of said container in the form of a stable foam, said composition comprising:

a) a silicone oil;

b) a liquid propellant; and c) a foam builder comprising a solid, non-ionic lipophilic surfactant having an HLB value of about 3 to about 8.

2. The foamable composition as recited in claim 1 wherein said silicone oil is in the form of an aqueous emulsion including a polysiloxane having a melting point no greater than about 32° F. (0° C.).

3. The foamable composition as recited in claim 1 wherein said silicone oil includes polydimethylsiloxane.

4. The foamable composition as recited in claim 1 wherein said liquid propellant is a volatile hydrocarbon propellant.

5. The foamable composition as recited in claim 1 wherein said liquid propellant includes a member selected from the group consisting of propane, n-butane, isobutane, hexane, n-pentane, 2-methylbutane, 1-pentene, butene, 2-methyl-2-butene, cyclobutane, cyclopentane and cyclohexane.

6. The foamable composition as recited in claim 1 wherein said surfactant includes a member selected from the group consisting of fatty alcohol ethers, fatty acid esters and fatty acid amides.

7. The foamable composition as recited in claim 1 wherein said surfactant includes an alkoxylated fatty alcohol.

8. The foamable composition as recited in claim 1 wherein said surfactant includes a member selected from the group consisting of ethoxylated (2) cetyl alcohol, ethoxylated (2) stearyl alcohol, and mixtures thereof.

9. The foamable composition as recited in claim 1 including a high temperature foam stabilizer having a melting point no less than about 110° F. (43° C.).

10. The foamable composition as recited in claim 9 wherein said high temperature foam stabilizer is a polar, linear saturated long chain fatty alcohol having twenty or more carbon atoms.

11. The foamable composition as recited in claim 9 wherein said surfactant comprises a member selected from the group consisting of ethoxylated (2) cetyl alcohol, ethoxylated (2) stearyl alcohol, and mixtures thereof; and said high temperature foam stabilizer includes behenyl alcohol.

12. The foamable composition as recited in claim 1 including a dispersant capable of dissolving or dispersing said surfactant.

13. The foamable composition as recited in claim 12 wherein said dispersant is isopropanol.

14. The foamable composition as recited in claim 1 having a viscosity no greater than about $10^4$ cP.

15. A foamable lubricant composition adapted to be dispensed through a valve of a spray container in the form of a foam capable of maintaining a stable foam structure for a period of at least approximately 16 hours, said composition comprising:

a) a liquid propellant;

b) an aqueous emulsion including at least about 50 wt % silicone oil based on a mass of said emulsion, said emulsion being present in an amount of at least 85 wt % based on a partial weight of said composition excluding said liquid propellant; and c) a solid, non-ionic lipophilic surfactant having an HLB value of about 3 to about 8, said surfactant being present in an amount of about 1 wt % to about 10 wt % based on said partial weight of said composition excluding said liquid propellant.

16. The foamable composition as recited in claim 15 wherein said silicone oil includes a polysiloxane having a melting point no greater than about 32° F. (0° C.).

17. The foamable composition as recited in claim 15 wherein said silicone oil includes polydimethylsiloxane.

18. The foamable composition as recited in claim 15 wherein said liquid propellant is a volatile hydrocarbon propellant.

19. The foamable composition as recited in claim 15 wherein said liquid propellant includes a member selected from the group consisting of propane, n-butane, isobutane, hexane, n-pentane, 2-methylbutane, 1-pentene butene, 2-methyl-2-butene, cyclobutane cyclopentane and cyclohexane.

20. The foamable composition as recited in claim 15 wherein said liquid propellant is present in an amount of about 2 wt % to about 10 wt % based on a total weight of said composition.

21. The foamable composition as recited in claim 15 wherein said surfactant has an HLB value of about 3.5 to about 6.

22. The foamable composition as recited in claim 15 wherein said surfactant includes a member selected from the group consisting of fatty alcohol ethers, fatty acid esters and fatty acid amides.

23. The foamable composition as recited in claim 15 wherein said surfactant includes an alkoxylated fatty alcohol.

24. The foamable composition as recited in claim 15 wherein said surfactant includes a member selected from the group consisting of ethoxylated (2) cetyl alcohol, ethoxylated (2) stearyl alcohol, and mixtures thereof.

25. The foamable composition as recited in claim 15 including a high temperature foam stabilizer having a melting point no less than about 110° F. (43° C.), said high temperature foam stabilizer being present in an amount of about 0.25 wt % to about 10 wt % based on said partial weight of said composition excluding said liquid propellant.

26. The foamable composition as recited in claim 25 wherein said high temperature foam stabilizer is a polar, linear saturated long chain fatty alcohol having twenty or more carbon atoms.

27. The foamable composition as recited in claim 15 wherein said surfactant includes a member selected from the group consisting of ethoxylated (2) cetyl alcohol, ethoxylated (2) stearyl alcohol, and mixtures thereof, and said high temperature foam stabilizer includes behenyl alcohol.

28. The foamable composition as recited in claim 15 including a dispersant capable of dissolving or dispersing said surfactant, said dispersant being present in an amount of about 1 wt % to about 5 wt % of said partial weight of said composition excluding said liquid propellant.

29. The foamable composition as recited in claim 28 wherein said dispersant is isopropanol.

30. The foamable composition as recited in claim 15 having a viscosity no greater than about $10^4$ cP.

31. A foamable lubricant composition having a viscosity no greater than about $10^4$ cP, said composition being adapted to be dispensed through a valve of an aerosol canister in the form of a foam capable of maintaining a stable foam structure for a period of at least approximately 16 hours, said composition comprising:

a) a liquid propellant including a volatile liquid hydrocarbon;

b) an aqueous emulsion including at least about 50 wt %. based on a mass of said aqueous emulsion, of a polysiloxane having a melting point no greater than about 32° F. (0° C.), said emulsion being present in an amount of at least 85 wt % based on a partial weight of said composition excluding said liquid propellant;

c) a solid, non-ionic lipophilic surfactant having an HLB value of about 3 to about 8, said surfactant including a member selected from the group consisting of fatty alcohol ethers, fatty acid esters and fatty acid amides and being present in an amount of about 1 wt % to about 10 wt % based on said partial weight of said composition excluding said liquid propellant; and d) a high temperature foam stabilizer including a polar, linear saturated long chain fatty alcohol having twenty or more carbon atoms, said high temperature foam stabilizer having a melting point no less than about 101° F. (43° C.) and being present in an amount of about 0.25 wt % to about 10 wt % based on said partial weight of said composition excluding said liquid propellant.

32. The foamable composition as recited in claim 31 wherein said silicone oil includes polydimethylsiloxane.

33. The foamable composition as recited in claim 31 wherein said volatile liquid hydrocarbon is selected from the group consisting of propane, n-butane, isobutane, hexane, n-pentane, 2-methylbutane, 1-pentene, butene, 2-methyl-2-butene, cyclobutane, cyclopentane and cyclohexane.

34. The foamable composition as recited in claim 31 wherein said liquid propellant is present in an amount of about 2 wt % to about 10 wt % based on a total weight of said composition.

35. The foamable composition as recited in claim 31 wherein said surfactant has an HLB value of about 3.5 to about 6.

36. The foamable composition as recited in claim 31 wherein said surfactant includes an alkoxylated fatty alcohol.

37. The foamable composition as recited in claim 31 wherein said surfactant includes a member selected from the group consisting of ethoxylated (2) cetyl alcohol, ethoxylated (2) stearyl alcohol, and mixtures thereof, and said high temperature foam stabilizer includes behenyl alcohol.

38. The foamable composition as recited in claim 31 including a dispersant capable of dissolving or dispersing said surfactant, said dispersant being present in an amount of about 1 wt % to about 5 wt % of said partial weight of said composition excluding said liquid propellant.

39. The foamable composition as recited in claim 38 wherein said dispersant is isopropanol.

40. Method of lubricating a surface comprising:

a) forming a foamable composition comprising a silicone oil, a liquid propellant, and a solid, non-ionic lipophilic surfactant wherein said surfactant has an HLB value of about 3 to about 8;

b) applying said composition to said surface in a foamed composition form, said foamed composition being characterized as a durable foam that does not substantially collapse sixteen hours after said applying.

41. Method as recited in claim 40 wherein said silicone oil is in the form of an aqueous emulsion including polysiloxane.

42. Method as recited in claim 41 wherein said polysiloxane comprises polydimethylsiloxane.

43. Method as recited in claim 40 wherein said liquid propellant is a volatile hydrocarbon propellant.

44. Method as recited in claim 40 wherein said liquid propellant includes a member selected from the group consisting of propane, n-butane, isobutane, hexane, n-pentane, 2-methylbutane, 1-pentene, butene, 2-methyl-2-butene, cyclobutane, cyclopentane and cyclohexane.

45. Method as recited in claim 40 wherein said surfactant includes a member selected from the group consisting of fatty alcohol ethers, fatty acid esters and fatty acid amides.

46. Method as recited in claim 40 wherein said surfactant includes an alkoxylated fatty alcohol.

47. Method as recited in claim 40 wherein said surfactant includes a member selected from the group consisting of ethoxylated (2) cetyl alcohol, ethoxylated (2) stearyl alcohol, and mixtures thereof.

48. Method as recited in claim 40 wherein said foamable composition comprises a high temperature foam stabilizer having a melting point no less than about 110° F. (43° C.).

49. Method as recited in claim 48 wherein said high temperature foam stabilizer is a polar, linear saturated long chain fatty alcohol having twenty or more carbon atoms.

50. Method as recited in claim 48 wherein said surfactant comprises a member selected from the group consisting of ethoxylated (2) cetyl alcohol, ethoxylated (2) stearyl alcohol, and mixtures thereof, and said high temperature foam stabilizer includes behenyl alcohol.

51. Method as recited in claim 49 including a dispersant capable of dissolving or dispersing said surfactant.

52. Method as recited in claim 51 wherein said dispersant is isopropanol.

53. Method as recited in claim 40 wherein said foamable composition has a viscosity no greater than about $10^4$ cP.

* * * * *